US005259441A

United States Patent [19]

Staub

[11] Patent Number: 5,259,441

[45] Date of Patent: Nov. 9, 1993

[54] APPARATUS FOR THE PRODUCTION OF DIRECTIONALLY SOLIDIFIED CASTINGS

[75] Inventor: Fritz Staub, Seuzach, Switzerland

[73] Assignee: Sulzer Brothers Limited, Winterthur, Switzerland

[21] Appl. No.: 848,799

[22] Filed: Mar. 9, 1992

[30] Foreign Application Priority Data

Mar. 26, 1991 [CH] Switzerland ..... 00919/91

[51] Int. Cl.[5] ..... B22D 27/04

[52] U.S. Cl. ..... 164/348; 164/361; 164/122.1

[58] Field of Search ..... 164/122.1, 122.2, 361, 164/348

[56] References Cited

U.S. PATENT DOCUMENTS 4,062,399 12/1977 Lirones ..... 164/361

4,813,470 3/1989 Chiang ..... 164/122.1

*Primary Examiner*—Kuang Y. Lin

*Attorney, Agent, or Firm*—Townsend and Townsend Khourie and Crew

[57] ABSTRACT

The apparatus for the production of directionally solidified castings (10) in a vacuum casting plant comprises a cooling attachment with members (60) between a flat cooling plate (6) and the mold shell (2), by means of which member zones of different orientation of the direction of solidification can be produced in the casting. This apparatus is particularly suitable for the production of components in the form of a wheel—e.g. turbine wheels in aircraft jet engines—in which a radial alignment of the texture structure is advantageous in order to increase strength.

9 Claims, 3 Drawing Sheets

APPARATUS FOR THE PRODUCTION OF DIRECTIONALLY SOLIDIFIED CASTINGS

BACKGROUND OF THE INVENTION

The invention relates to apparatus for the production of directionally solidified castings and castings produced by means of such apparatus.

An inexpensive process in which mold shells having integrated heat sources are used (F. Staub et al, Technische Rundschau Sulzer 3/1988, p. 11) is known for the production of relatively small directionally solidified castings (length in the direction of solidification less than about 15 cm). The integrated heat sources are, for example, additional cavities in the mold shell which, filled with superheated melt, enable casting to be carried out without heating means (susceptors) in the casting chamber. The mold shell itself and the mold thermal insulation which must be used, also contribute to the integrated heat sources.

The mold shell has a bottom aperture which is closed by a flat cooling plate in the casting chamber. Solidification of the melt starts at this aperture during casting. The cooling plate acting as a heat sink and the integrated heat sources form the poles of a temperature field which allows a "uni-directional" heat flow and hence a directional solidification. In the known processes the cooling plate forms a horizontal plane with respect to which the dendrites forming on solidification have a substantially vertical growth direction.

In castings made from nickel based alloys, e.g. for turbine blades for aircraft jet engines, the elongation strengths in the direction of the dendrites and hence the lives of the components during operation are greatly improved as compared with polycrystalline castings. Since the dendrites will be substantially radially oriented in the turbine wheel blades, the wheel must be assembled from individual directionally solidified castings. The production of the wheel would be simplified if it were possible to cast components having directionally solidified zones whose texture structures have different orientations. It is the object of the invention to provide an apparatus which allows the production of such components.

SUMMARY OF THE INVENTION

The cooling attachment applied to the horizontal cooling plate means that the dendrite growth has different orientations in zones. By suitable configuration of the cooling attachment it is possible to manufacture segmental castings which can be assembled to form components in the form of wheels having radially oriented dendrites; alternatively, connected wheel-like components can be cast in which directional solidification results in the formation of dendrites which are aligned at least approximately radially.

DESCRIPTION OF THE PREFERRED EMBODIMENTS

Figure 1:
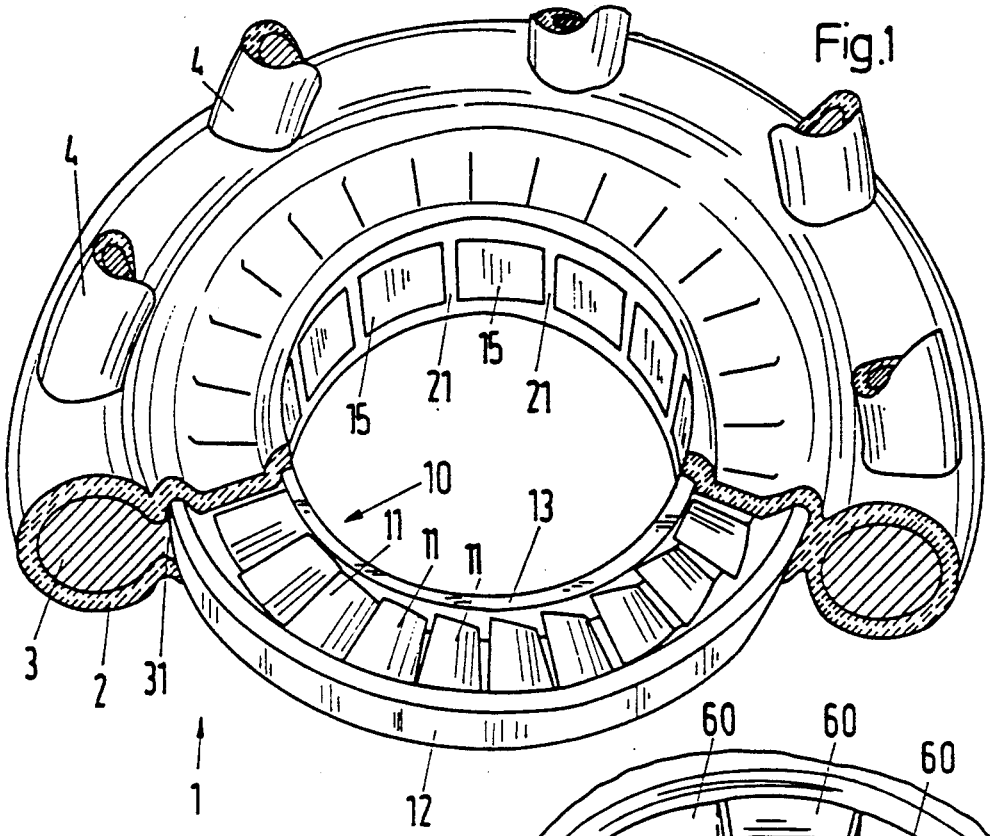
FIG. 1 shows a component in the form of a wheel adapted to be produced by the apparatus according to the invention and partially embedded in the mold shell (first exemplified embodiment)
Figure 3:
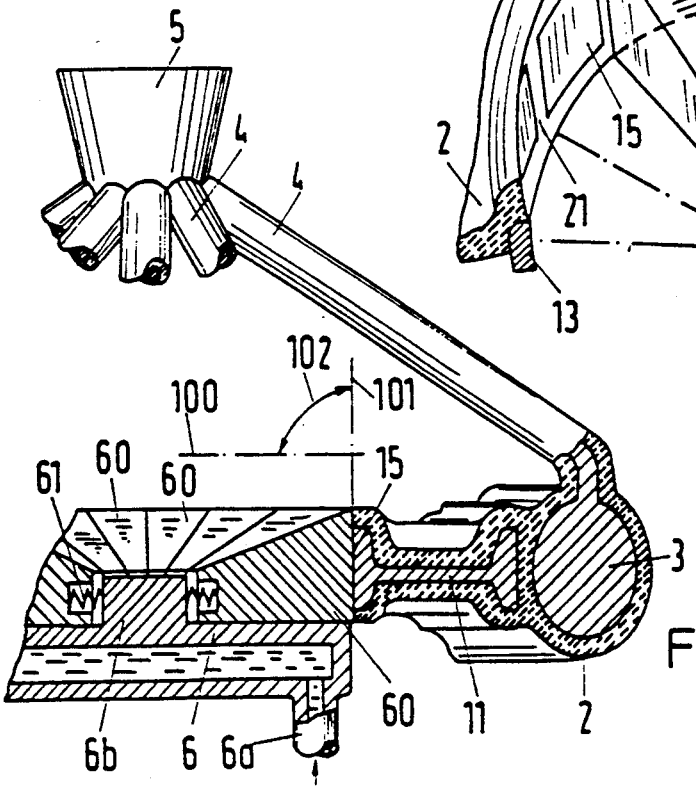
FIG. 3 is a radial section through the cooling plate, cooling attachment and filled mold shell of the first exemplified embodiment.

The component 10 shown in FIG. 1 consists of the radial blades 11, the outer ring 12 and the inner ring 13. A toroidal cavity 3 is integrated in the mold shell 2 and encircles the actual mold shell for the component 10 ring a ring-like manner. (The cavity 3 may also be divided up into sectors forming separate chambers. In this way it is possible to prevent stresses which may occur on solidification.) The melt flows via gate 5 (see FIG. 3-not shown in FIG. 1) via a number of ducts 4 into the torus 3 and then through apertures 31 distributed over the periphery of the outer ring 12 into the central area of the mold shell 2. The torus 3 forms the main part of the heat source integrated in the mold shell. A thermal insulation with which the outer surface of the mold shell 2 must be enclosed is not shown.

Figure 2:
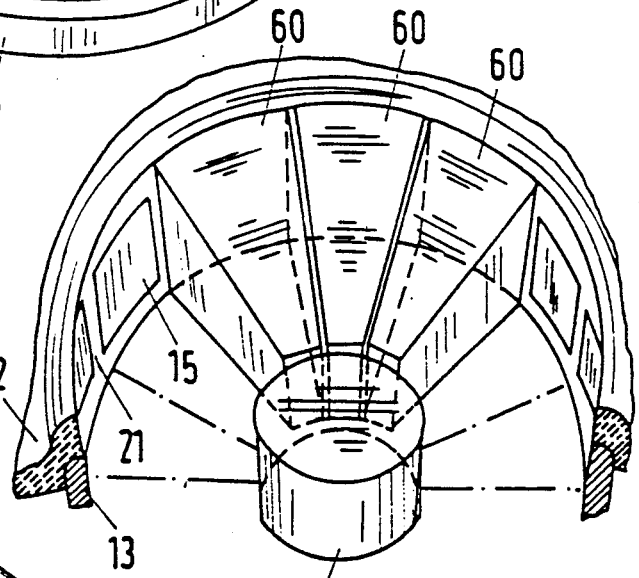
FIG. 2 shows three sectors of the cooling attachment of the first exemplified embodiment.

On the inside the mold shell 2 has apertures 15 separated from one another by webs 21 of the mold shell 2. As will be seen in FIG. 2, the apertures 15 are closed by members 60 in the form of sectors. These members 60, which are disposed in a ring around a central part 6*b*, consist of a material having good thermal conductivity, e.g. copper; they serve to dissipate heat on solidification of the melt. As will be seen from the cross-section in FIG. 3, the members 60 are disposed on the cooling plate 6 (connecting line 6*a*) and are supported with respect to the central part 6*b* by means of compression springs 61. Radially narrow gaps are provided between the members 60 of the cooling attachment. They permit a change of geometry during volume reduction resulting from the solidification of the casting, the cooling attachment being constructed to yield radially.

Between the heat sink formed by the members 60, on the one hand, and the heat source formed by the superheated melt in the toroidal cavity 3, on the other hand, a radial temperature field forms. After the shock-like start of solidification at the apertures 15 dendrites grow out of a polycrystalline transition zone and follow the temperature field with minor deviations in the blades 11. In this way the wheel-shaped component forms with the required radial orientation of the texture structure.

Figure 4:
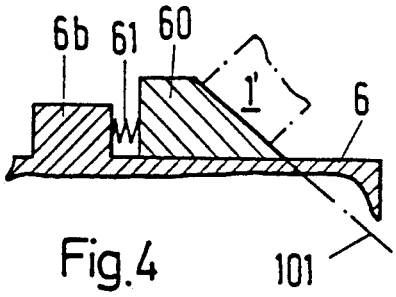
FIG. 4 is a variant of the cooling attachment of the first exemplified embodiment.

To enable the mold shell 2 to be fitted quickly onto the cooling members 60, the casting 1 is advantageously given a shape in which the inner ring 13 is slightly conical; the angle 102 between the horizontal 100 and the verticals 101 that the members 60 have at the interface at the apertures 15 should be somewhat smaller than a right angle. Depending upon the component the vertical 101 may also deviate considerably from the vertical (see FIG. 4 where the position of the casting is indicated in dot-dash lines and with the reference 1').

Figure 5A:
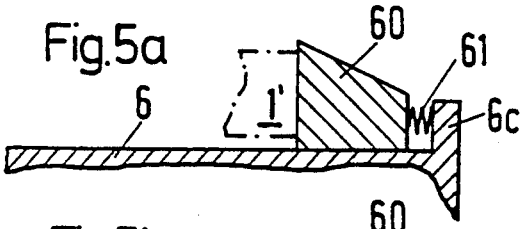
FIG. 5*a* shows the cooling attachment of a second exemplified embodiment.
Figure 5B:
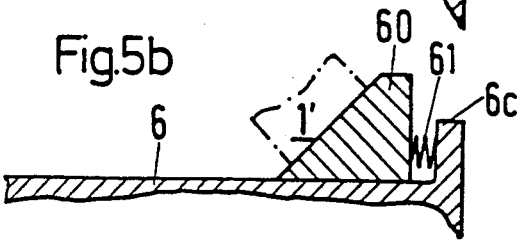
FIG. 5*b* shows a variant of the second exemplified embodiment.

In the second exemplified embodiment (FIGS. 5*a* and 5*b*) the members 60 arranged in a ring are again supported with respect to an annular edge 6*c* via compression springs 61. The two variants illustrated correspond to the two variants of the first exemplified embodiment. Here the directional solidification takes place radially inwards from outside.

Figure 6:
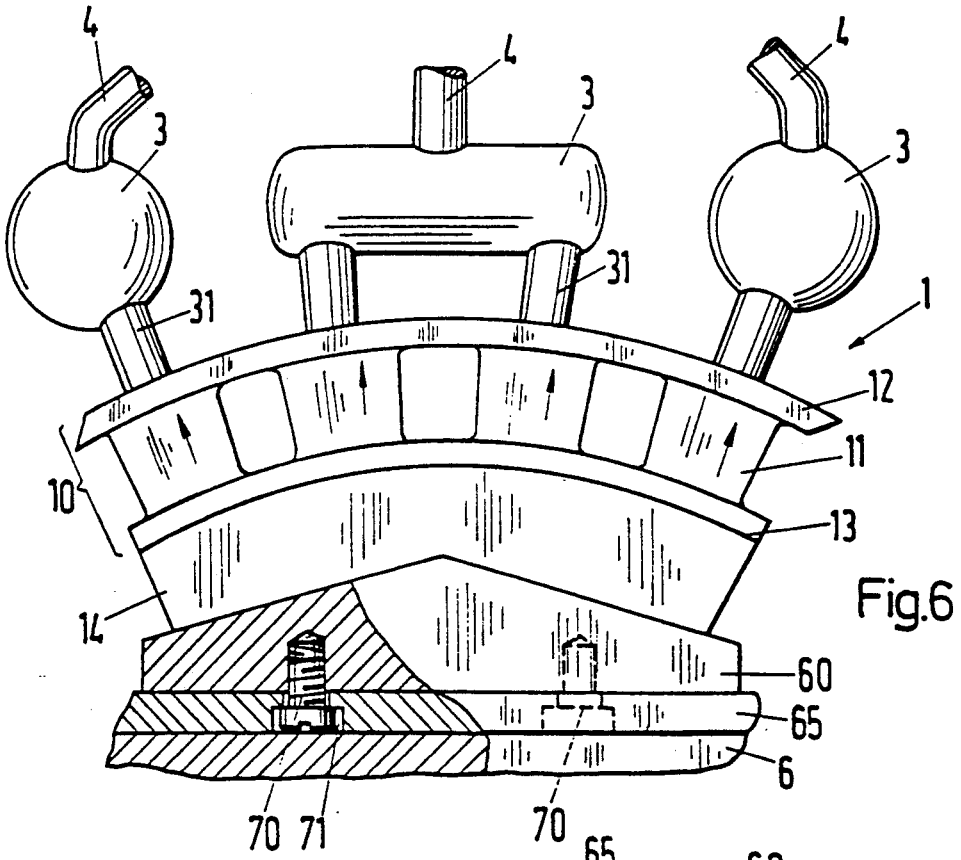
FIG. 6 shows a third exemplified embodiment in which the casting is a component segment.

The third exemplified embodiment shown in FIG. 6 is a casting 1 having a component 10 in the form of a segment which together with another five components 10 can be assembled to form a component in the form of a wheel. The mold shell (not shown) again comprises not only the cavity for the component 10 but also cavities for the integrated heat sources 3 with the associated connecting lines 4 and 31 and a cavity for a starter base 14 in which the directional solidification develops. The member 60 of the cooling attachment has two flat zones as the interface with the casting 1, these zones including an angle of 30°. Accordingly, on solidification two zones form in the casting with different orientations of dendrite alignment, i.e. by an angle which is at least approximately also 30°. In this case the radial alignment of the dendrites can be achieved only approximately.

The members 60 of the cooling attachment are advantageously mounted on an intermediate plate 65, the connection being so made, for example by means of screws 70, that there is a clearance 71 left for the movement of the screw head. This connection then allows a limited sliding movement of the member 60 about a zero position, of, for example, at least one millimeter. If a plurality of castings are combined to form a cluster, then the cooling attachment can react resiliently owing to the movability of its members 60 in response to small changes in the geometry of the cluster such as occur on heating of the ceramic and on solidification of the melt.

Figure 7:
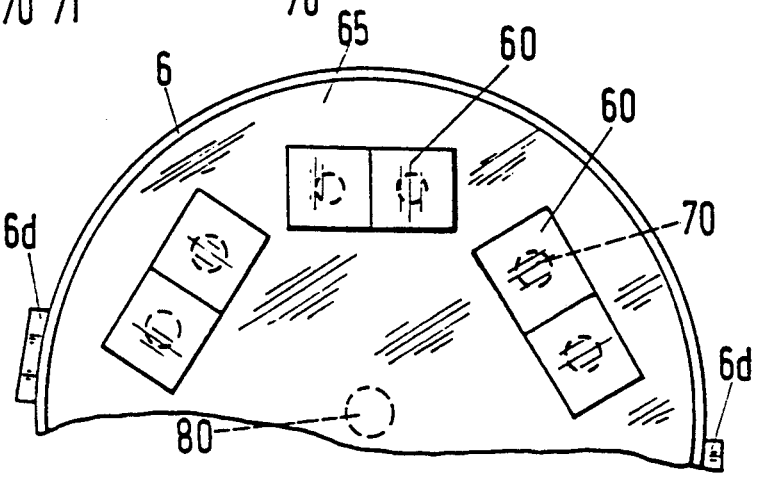
FIG. 7 is a plan view of the cooling plate with the cooling attachment for the third exemplified embodiment.

The cooling plate 6 shown in FIG. 7 comprises a cooling attachment with members 60 for a cluster with six components 10 (as in FIG. 6). The mold shell for the cluster is advantageously provided with an annular edge at its base having grooves to form a bayonet lock. The mold shell can be rapidly and securely connected to the cooling system by means of the claws 6*d* at the sides of the cooling plate 6, these claws forming the co-acting elements for the grooves of the bayonet lock. To enable the rotary movement required for the bayonet lock to be performed, the intermediate plate 65 must be mounted rotatably on the cooling plate 6. To this end, a pin 80 is provided in the center of the cooling plate 6 and engages in a corresponding bore in the intermediate plate 65.

Figure 8A:
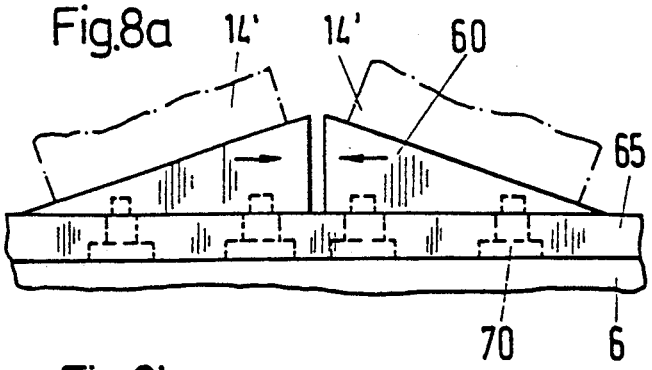
FIGS. 8*a* to 10*c* show different variants of the cooling attachments used for the production of segmental components as in the third exemplified embodiment and which can be assembled from at least two members for each component.
Figure 8B:
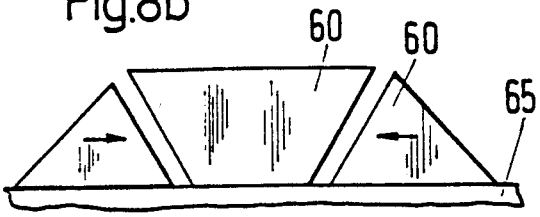
Figure 8C:
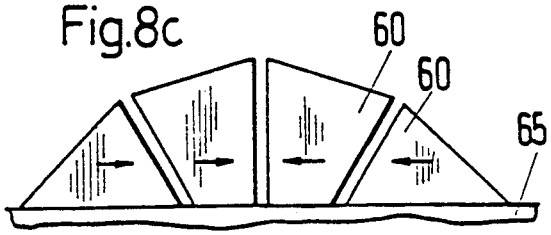

On solidification of the melt the volume decreases by about 2%. This shrinkage in volume is generally accompanied by a change in the geometry of the casting in the form of a contraction. Because of this contraction it is advantageous to assemble the cooling attachment from a plurality of relatively displaceable members 60. Instead of the connected member 60 in the third exemplified embodiment it is preferable to use a cooling attachment comprising 2, 3 or 4 members 60 as shown in FIGS. 8*a* to 8*c* (the arrows indicate the displaceability of the members 60). The larger the segment angle of the component 10, i.e., the fewer of such components 10 required for assembling the complete wheel component, the more members 60 must be used in the cooling attachment per component 10.

Figure 9A:
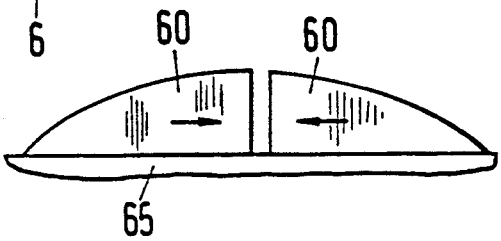
Figure 9B:
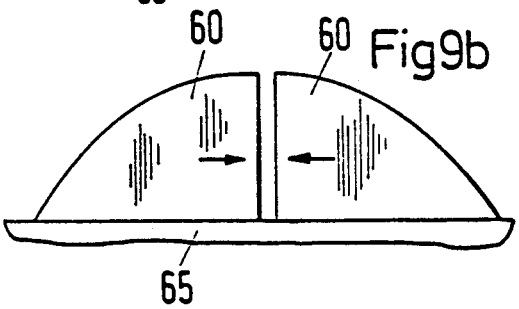

Instead of making the surfaces of the members 60 flat, they may also be curved as shown in FIGS. 9*a* and 9*b*.

Figure 10A:
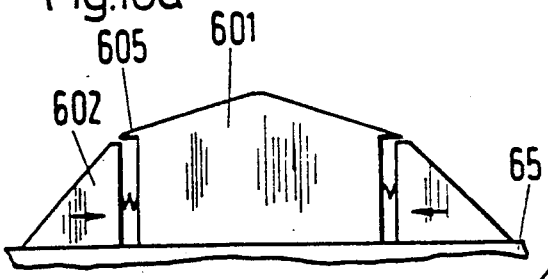
Figure 10B:
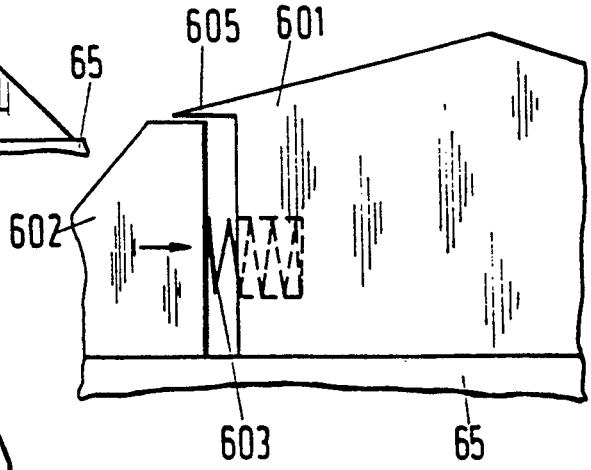
Figure 10C:
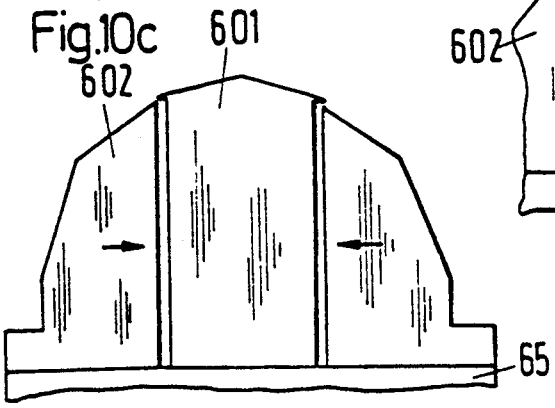

To prevent melt from flowing out of the mold shell through the gaps between the members 60, the casting mold must be so devised that the apertures of the mold shell are not situated over these gaps—for example by means of base portions 14' (see FIG. 8*a*). Other steps may, however, be taken to prevent the melt from flowing away. This is shown with reference to FIGS. 10*a* to 10*c*: the gap between two adjacent members 601 and 602 is covered by a roof-shaped projection 605 of the member 601 (see FIG. 10*b*, which is an enlarged detail of FIG. 10*a*). The projection 605 bears closely on a small horizontal region of the member 602 in such manner as not to prevent any sliding movement of the member 602 relatively to the member 601.

The individual members 60, 601 and 602 may be mounted on an intermediate plate 65 with connecting means 70 (see FIG. 8*a*) in the same way as in the third exemplified embodiment. They can also be interconnected by compression springs 603 (see FIG. 10*b*) as in the first exemplified embodiment.

What is claimed is:

1. Apparatus for the production of directionally solidified castings from a melt including a vacuum casting machine having a flat cooling plate, mold shells for holding the melt during its solidification and having integrated heat sources, at least one aperture for starting the solidification of and heat dissipation in the cast melt, and a cooling attachment disposed between the cooling plate and the mold shells including at least one thermally conductive member, the cooling attachment forming a thermally conductive closure for the mold shell presenting an interface to the cast melt proximate the aperture with at least two zones which are inclined to one another.

2. Apparatus according to claim 1, wherein the cooling attachment comprises a plurality of members arranged in the form of a ring.

3. Apparatus according to claim 2, wherein the cooling plate has an upwardly extending central part and including springs disposed between the central part and the cooling attachment members displaceable on the cooling plate.

4. Apparatus according to claim 2, wherein the cooling plate has an annular upwardly extending edge part and compression springs disposed between the edge part and the cooling attachment members displaceable on the cooling plate.

5. Apparatus according to claim 1, including a rotatably mounted thermally conductive intermediate plate disposed between the cooling plate and the cooling attachment.

6. Apparatus according to claim 5, wherein at least some of the cooling attachment members are mounted on the intermediate plate and including connecting means securing the attachment members to the intermediate plate and allowing a limited sliding movement of the members about a zero position of at least 1 millimeter.

7. Apparatus according to claim 5, comprising only one connected cooling attachment member associated with each casting.

8. Apparatus according to claim 5, comprising at least two cooling attachment members associated with each casting.

9. Apparatus according to claim 8, including compression springs disposed between the cooling attachment members.

* * * * *